United States Patent [19]

Kobayashi

[11] 4,306,483

[45] Dec. 22, 1981

[54] DAMPER ASSEMBLY FOR PIANOS

[75] Inventor: Eiji Kobayashi, Hamamatsu, Japan

[73] Assignee: Nippon Gakki Seizo Kabushiki Kaisha, Japan

[21] Appl. No.: 87,491

[22] Filed: Oct. 23, 1979

[30] Foreign Application Priority Data

Oct. 24, 1978 [JP] Japan ..... 53-145304[U]
Oct. 24, 1978 [JP] Japan ..... 53-145307[U]
Oct. 24, 1978 [JP] Japan ..... 53-145308[U]
Oct. 24, 1978 [JP] Japan ..... 53-145309[U]

[51] Int. Cl.[3] ..... G10C 3/16
[52] U.S. Cl. ..... 84/255
[58] Field of Search ..... 84/217–218, 84/234, 236–239, 255

[56] References Cited

U.S. PATENT DOCUMENTS 399,710 3/1889 Steck ..... 84/404
457,714 8/1891 Hastings ..... 84/255

FOREIGN PATENT DOCUMENTS 385752 5/1908 France ..... 84/255
15613 of 1914 United Kingdom ..... 84/255

*Primary Examiner*—Lawrence R. Franklin
*Attorney, Agent, or Firm*—Lerner, David, Littenberg & Samuel

[57] ABSTRACT

A damper assembly for pianos is provided with at least two damper felt sections disposed to its damper head in such a manner to enable dual staged damping action, only the large amplitude components of string vibration being damped in the first stage, and the remainder of the string vibration being almost fully damped in the second stage. Stable damping effect on the string and minimized jumping of the damper felts are attained in particular in the bass range.

14 Claims, 15 Drawing Figures

DAMPER ASSEMBLY FOR PIANOS

BACKGROUND OF THE INVENTION

The present invention relates to improved damper assembly for pianos, and more particularly relates to improved mounting construction of damper felts to a damper head.

On a piano, one damper assembly is provided for each key in the keyboard and different damper assemblies for different keys are operable independently of each other upon key operation. In addition, damper assemblies for all keys in the keyboard are simultaneously operable all together upon foot pedal operation, too.

A damper assembly includes, as major elements, a swingable damper lever, a damper wire carried by the damper lever, a damper head mounted atop the damper wire and damper felts disposed to the damper head whilst facing an associated key. When the associated key is left free, the damper felts rest on the string in order to restrict its free vibration.

In the conventional construction, each damper felt is provided in its bottom face with a center longitudinal V-shaped groove for good engagement with the associated string.

As later described in more detail, however, presence of such a bottom groove tends to promote easy buckling, i.e. deformation, of the damper felt after long and repeated use, which causes insufficient damping effect and easy jumping of the damper felt on the string.

SUMMARY OF THE INVENTION

It is the primary object of the present invention to furnish an effective damping function to the damper assemblies especially in the lower tonal range.

It is another object of the present to elongate the life of a damper felt without degrading its initial damping effect.

In accordance with the present invention, means for applying dual staged damping action to strings is provided so that large amplitude components of string vibration can be absorbed in advance to the main ultimate damping.

DESCRIPTION OF THE PREFERRED EMBODIMENTS

Figure 1:
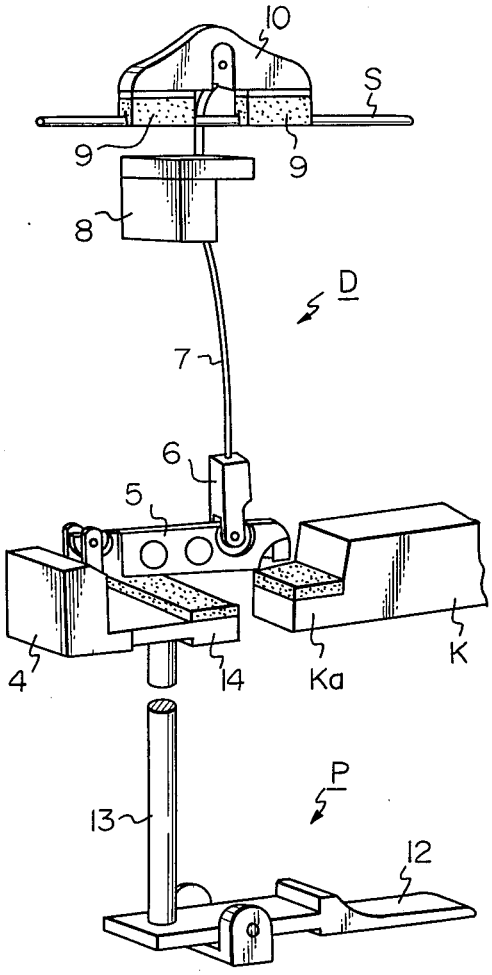
Fig. 1 PRIOR ART
FIG. 1 is a side view of the typical construction of a conventional damper assembly and its related parts.

A typical example of the conventional damper assembly and its related parts is illustrated in FIG. 1.

In the construction, the damper assembly D for each key is arranged behind and above the rear end Ka of the associated key K, which is swingable about a balance pin (not shown). A damper lever 5 is swingably mounted at its rear end to a damper lever flange 4 fixed to a damper rail (not shown) which extends over the entire width of the keyboard. A damper wire 7 is fixed at its bottom end to a damper block 6 which is pivoted near the free end of the damper lever 5. The damper wire 7 extends upwards and carries at its top end a damper head 10. The damper head 10 is provided on its bottom face with damper felts 9 facing an associated string S. The damper wire 7 idealy extends through a damper guide rail 8 which is arranged for stable vertical movement of the damper wire 7.

When no operation is applied to the key K, the damper felts 9 rest on the string S due to the weight of the damper assembly D itself in order to restrict free vibration of the string S. When the associated key K is operated, its rear end Ka rises in order to thrust up the free end of the damper lever 5 and the damper wire 7 in turn moves the damper head 10 upwards so that the damper felts 9 leave the string S. Thereupon, the string S is struck by an associated action assembly (not shown) for generation of a corresponding musical tone.

In addition to the above-described key operation, the damper assembly D may be driven for movement by operation of a pedal assembly P arranged below the casing of the piano.

The pedal assembly P includes a damper pedal 12 swingably arranged at a position near the feet of the player. The damper pedal 12 is provided at its rear end with an upwardly extending damper pedal rod 13. A lifting rail 14 is pivoted at its rear end to the damper lever flange 4 at a position below the damper lever 5 so that its free end rests on the top of the damper pedal rod 13. The lifting rail 14 extends over the entire width of the keyboard so that it is simultaneously operable on damper levers 5 for all keys in the keyboard.

When the damper pedal 12 is stepped on by the player, its damper pedal rod 13 thrusts up the lifting rail 14 which in turn swings up the damper levers 5 for all keys so that all strings are released from restriction by their associated damper felts.

Thus, upon individual key operation, a string corresponding to the operated key is released from its associated damper restriction for free vibration, thereby generating a musical tone of the note of the operated key. On the other hand, upon individual pedal operation, all strings are released from their associated damper restrictions for free vibrations, thereby causing resonance of unoperated keys when any key is operated. Such resonance enriches total tone volume and elongates tonal decay.

Figure 2:
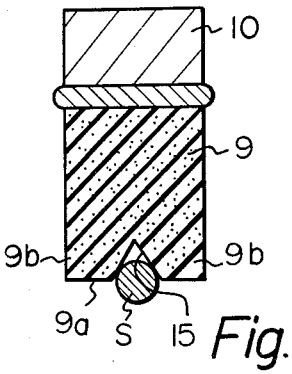
Fig. 2 PRIOR ART
FIG. 2 is a transverse cross sectional view of the damper head and the string in FIG. 1.

In either way, the damper felts 9 restrict free vibration of its associated string S when they are in engagement with the string S. For this purpose, each damper felt 9 used for the conventional damper assembly is provided in its bottom face 9*a* with a longitudinal V-shaped groove 15 for accommodating the associated string S as shown in FIG. 2.

Since each damper felt 9 is made of a relatively soft uniform felt material, presence of such a groove 15 causes both lower end sections 9*b* of the damper felt 9 to buckle outwards after repeated pressure engagement with the string S, thereby seriously deteriorating the shape of the damper felt 9. In addition, when the V-shaped groove 15 is placed off the center due to any manufacturing error, one of the lower end sections 9*b* with thinner width is more bendable outwards than the other, thereby promoting undesirable deformation of the damper felt 9. Such deformation of the damper felts surely causes insufficient damping effect on the string as described already.

Figure 3:
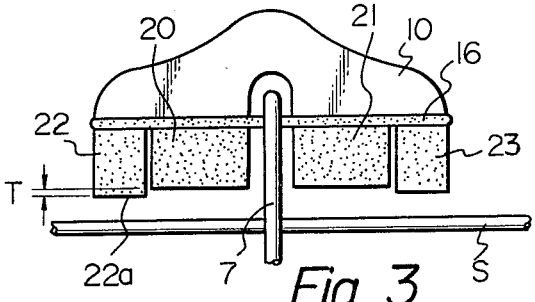
FIG. 3 is a side view of one embodiment of the damper head of the present invention.

One embodiment of the damper assembly in accordance with the present invention is shown in FIG. 3, in which elements substantially similar in construction and function to those used for the conventional construction shown in FIG. 1 are designated with similar reference numerals and symbols.

In this case, a damper head 10 is accompanied, by way of a conventional damper head lining felt 16 and, two pairs of damper felts 20, 21 and 22, 23. The inner side pair of felts 20 and 21 operate as the main damper felts whereas the outside pair of felts 22 and 23 operate as the auxiliary damper felts.

The main damper felts 20 and 21 are both made of a felt material similar in hardness to that used for the conventional damper felt 9. The auxiliary damper felts 22 and 23 are made of a felt material softer than that used for the conventional damper felt 9. In other words, the main and auxiliary damper felts differ from each other in their stiffness.

In addition to the above-described difference in stiffness, the main and auxiliary damper felts 20, 21 and 22, 23 differ from each other in their bottom face level. More specifically, the auxiliary damper felts 22 and 23 extend downwords beyond the bottom faces of the main damper felts 20 and 21 by a distance T, when no external force acts on the damper felts.

Damping action with the above-described construction is carried out in the following fashion. As the pressure on the associated key is removed, the damper head 10 lowers due to the own weight of the damper assembly as is the case with the conventional construction.

With this initial lowering of the damper head 10, the auxiliary damper felts 22 and 23 come in contact with the associated string S in order to absorb large amplitude components of the string vibration because of their low stiffness and lower bottom face level. Further lowering of the damper head 10 causes compression of the auxiliary damper felts 22 and 23 by a thickness equal to the distance T. As a result, the main damper felts 20 and 21 are also brought into contact with the string S in order to bear against and be in contact pressure with the string S, thereby effectively absorbing the string vibration.

In accordance with the present invention, use of the auxiliary damper felts 22 and 23 enables dual staged damping of the string vibration, in which the string vibration is somewhat enfeebled in advance of contact of the main damper felts 20 and 21 with the vibrating string S, thereby effectively avoiding jump of the main damper felts and preventing undesirable deformation of the main damper felts. Thus, ideal damping effect is assured. As the main damper felts do not jump when they engage with the string, noises which might otherwise be generated by such jumping contact can be greatly minimized. The present invention is in particular advantageously applied to damping of musical tones in the bass and middle ranges.

Figure 4:
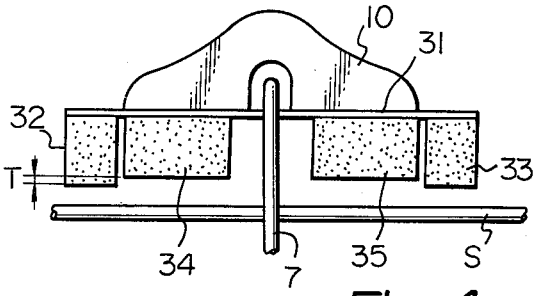
FIG. 4 is a side view of another embodiment of the damper head.

Another embodiment of the present invention is shown in FIG. 4, in which a leaf spring 31 is fixed to the bottom face of the damper head 10. The leaf spring extends beyond the longitudinal edges of the damper head 10 and carries four damper felts 32 to 35 having the same hardness. Like the foregoing embodiment, the outer side damper felts 32 and 33 extend beyond the bottom faces of the inner side damper felts 34 and 35 by a distance T.

As the damper head lowers, the outer side damper felts 32 and 33 engage with the associated string S in order to absorb large amplitude components of its vibration. As the damper head 10 further lowers, longitudinal end sections of the leaf spring 31 elastically flex upwards so that the inner side damper felts 34 engage with the string S and completely absorb its vibration. It will be clear that the outer side damper felts 32 and 33 operate as the auxiliary damper and the inner side damper felts 34 and 35 operate as the main damper. As a substitute for the difference in stiffness of the damper felts in the foregoing embodiment, the leaf spring 31 is used in the present embodiment in order to obtain similar damping effect.

Figure 5A:
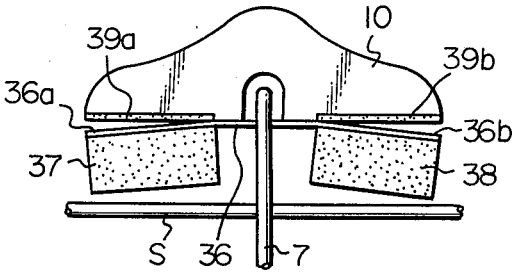
FIG. 5A is a side view of an other embodiment of the damper head apart from the string.

An other embodiment of the present invention is shown in FIG. 5A, in which the damper is separate from the associated string S. A leaf spring 36 is fixed, at its longitudinal middle section only, to the bottom face of the damper head 10. The length of the leaf spring 36 is substantially the same as that of the damper head 10. End sections 36*a* and 36*b* of the leaf spring 36 are slightly bent downwards and carry damper felts 37 and 38 which are somewhat harder than the conventional damper felts 9. Felts 39*a* and 39*b* are fixed to the end sections of the bottom face of the damper head 10 corresponding to the damper felts 37 and 38 in order to prevent noises at damping.

Figure 5B:
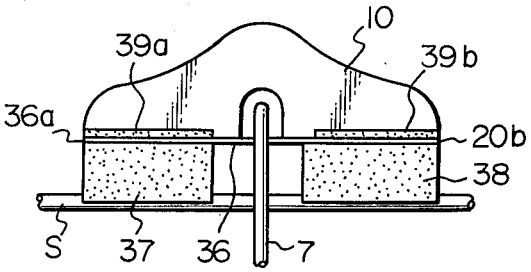
FIG. 5B is a side view of the damper head shown in FIG. 5A in contact with the string.

As the damper head 10 lowers, the damper felts 37 and 38 engage with the associated string S and the end sections 36*a* and 36*b* of the leaf spring 36 flex upwards. This elastic flexion absorbs the large amplitude components of the string vibration. As the damper head 10 further lowers, the end sections 36*a* and 36*b* of the leaf spring 36 contact the bottom felts 39*a* and 39*b* of the damper head 10 as shown in FIG. 5B and the damper felts 37 and 38 are brought into parallel contact with the string S in order to effectively restrain its vibration.

In the damping mechanism of this embodiment, dual staged absorption of the string vibration is carried out first by the leaf spring 36 and secondly by the damper felts 37 and 38.

Figure 6:
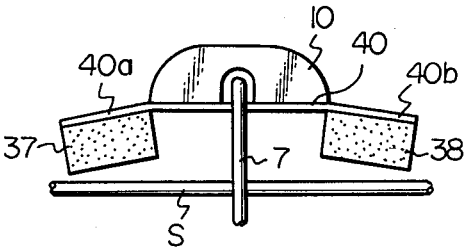
FIG. 6 is a side view of a further embodiment of the damper head.

A further embodiment of the present invention is shown in FIG. 6, in which a leaf spring 40 fixed to the bottom face of the damper head 10 is provided with longitudinal end sections 40*a* and 40*b* which extend beyond the longitudinal ends of the damper head 10 and are somewhat bent downwards. The damper felts 37 and 38 are fixed to the end sections 40*a* and 40*b* of the leaf spring 40.

Figure 7:
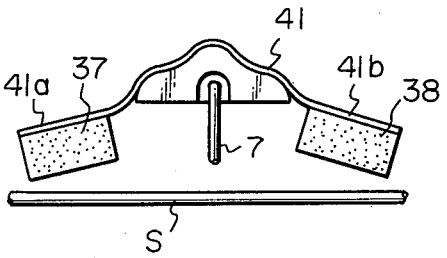
FIG. 7 is a side view of a further embodiment of the damper head.

A still further embodiment of the present invention is shown in FIG. 7, in which a leaf spring 41 is fixed to the top face of the damper head 10 and provided with end sections 41*a* and 41*b* extending beyond the longitudinal ends of the damper head 10, respectively. The damper felts 37 and 38 are fixed to the end sections 41*a* and 41*b* of the leaf spring 41.

Figure 8:
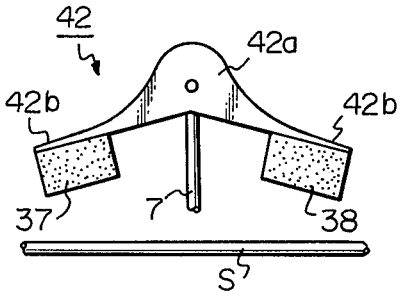
FIG. 8 is a side view of a further embodiment of the damper head.

A still further embodiment of the present invention is shown in FIG. 8, in which a damper head 42 is made by synthetic resin moulding and provided with longitudinally elongated thinner end sections 42*b* and 42*c*. The end sections 42*a* and 42*b* extend and somewhat decline from the main section 42*a* coupled to the top of the damper wire 7. The damper felts 37 and 38 are fixed to the bottom faces of the damper head end sections 42*b* and 42*a*.

Figure 9A:
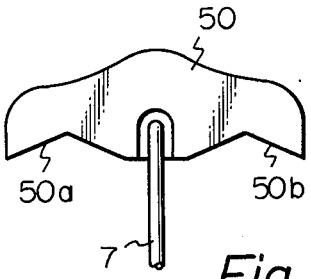
FIG. 9A is a side view of a further embodiment of the damper head in a disassembled state.
Figure 9B:
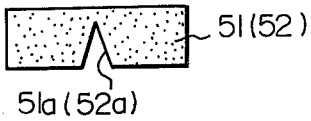
FIG. 9B is a side view of a damper felt in a disassembled state.
Figure 10:
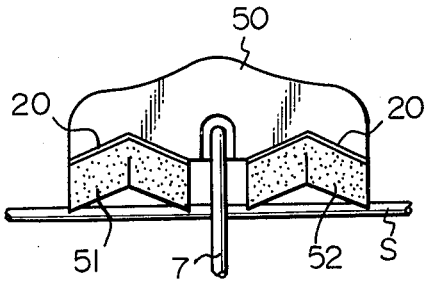
FIG. 10 is a side view of the damper head shown in FIG. 9A and 9B in the assembled state.

A still further embodiment of the present invention is shown in FIGS. 9A to 10. In the case of this embodiment, a damper head 50 is provided, on both longitudinal end sections, with a pair of transverse grooves 50*a* and 50*b* formed in its bottom face as shown in FIG. 9A. Each transverse groove 50*a* or 50*b* has a triangular cross section. Under a condition before assembly, each damper felt 51 or 52 has a V-shaped transverse groove 51*a* or 52*a* formed in its one face as shown in FIG. 9B.

In assembly, the damper felts 51 and 52 are bent along their transverse grooves 51*a* and 52*a* and fixed to the transverse grooves 50*a* and 50*b* in the damper head 50 by means of thin damper head lining felts 20. The V-shaped transverse grooves 51*a* and 52*a* of the damper felts 51 and 52 are shaped so that the damper felts 51 and 52 snugly fit the transverse grooves 50*a* and 50*b* of the damper head 50.

As the damper head 50 lowers, four longitudinal edges of the damper felts 51 and 52 engage with and press the string S as shown in FIG. 10. When compared with the entire surface contact of the conventional damper felts 9, the edge contact of the damper felts 51 and 52 of the present invention provides increased contact pressure per a unit surface area, thereby enabling ideal damping on the string. The damping effect is excellent in particular for musical tones in the bass range. Absence of the conventional longitudinal V-shaped groove in the damper felt bottom face effectively minimizes undesirable buckling of the damper felt. In addition, bending of the damper felt along its transverse bottom groove compresses its upper apex section and, as a result, generates internal stress in the apex section of the damper felt mounted to the damper head and presence of such internal stress further resists the buckling of the damper felt even after long and repeated use.

Figure 11:
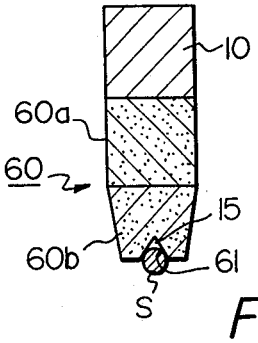
FIG. 11 is a transverse cross sectional view of a further embodiment of the damper head.

A still further embodiment of the present invention is shown in FIG. 11, in which a damper felt 60 has a double-layered construction. That is, the damper felt 60 includes a first section 60*a* bonded to the bottom face of the damper head 10 and a second section 60*b* bonded to the first section 60*a* and adapted for pressure contact with the associated string S.

The first section 60*a* is made of a felt material of a hardness substantially the same as that for the conventional damper felt 9. The second section 60*b* is made of a felt material harder than that for the conventional damper felt 9. Like the conventional damper felt 9, the second section 60*b* is provided in its bottom face with a longitudinal center V-shaped groove 61.

As the damper head 10 lowers, the second section 60*b* engages with the associated string S and the first section 60*a* absorbs string vibration through the second section 60*b*. As the second section 60*b* contacting the string S is made of a hard felt material, the lower end sections of the damper felt 60 do not buckle even after long and repeated use. In addition, the lower stiffness of the first section 60*a* enables excellent absorption of string vibration.

Figure 12:
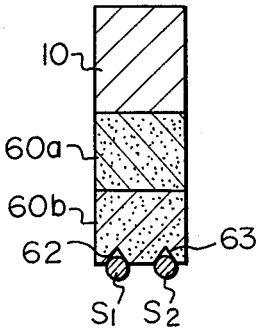
FIG. 12 is a transverse cross sectional view of a further embodiment of the damper head.

A modification of the foregoing damper is shown in FIG. 12, in which the damper felt 60 is made up of the first and second sections 60*a* and 60*b* different in stiffness. In this case, however, the second section 60*b* is provided in its bottom face with two longitudinal V-shaped grooves 62 and 63. This embodiment is particularly well suited for damping of musical tones in the bass range in which double strings are used in combination for each musical tone.

Figure 13:
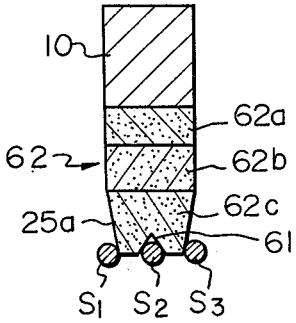
FIG. 13 is a transverse cross sectional view of a further embodiment of the damper head.

A still further embodiment of the present invention is shown in FIG. 13, in which a damper felt 62 has a triple-layered construction. That is, the damper felt 62 includes a softest first section 62*a* fixed to the bottom face of the damper head 10, a harder second section 62*b* bonded to the first section 62*a*, and a still harder third section 62*c* bonded to the second section 62*b*. The third section 62*c* is provided in its bottom face with a longitudinal center V-shaped groove 61 and its lower end outer surfaces are chamferred. This embodiment is particularly well suited for damping of musical tones in the bass range in which three strings are used in combination for each musical tone.

I claim:

1. An improved damper assembly for a piano comprising:

a damper head arranged relative to an associated string of the piano;

at least one damper felt disposed between said damper head and said associated string;

dual-staged applying means for applying first and second staged damping actions to said associated string, said dual-staged applying means being operatively associated with said damper head so that only large amplitude components of string vibrations are damped by the first staged damping action and the remnant of string vibration is almost fully damped by the second staged damping action;

said at least one damper felt being of a double layered construction having a first layer of felt material facing said string and a second layer of felt material facing said damper head, said first layer of felt material being harder than said second layer of felt material.

2. The improved damper assembly as claimed in claim 1 wherein said first layer facing said string includes a longitudinally extending groove in the face thereof facing said associated string.

3. The improved damper assembly as claimed in claim 1 in which said damper head is arranged relative to a pair of associated strings, and wherein said first layer of said at least one damper felt includes a pair of longitudinal grooves therein for engagement with said pair of associated strings.

4. An improved damper assembly for a piano comprising:

a damper head arranged relative to an associated string of the piano;

at least one damper felt disposed between said damper head and said associated string;

dual-staged applying means for applying first and second staged damping actions to said associated string; said dual-staged applying means being operatively associated with said damper head so that only large amplitude components of string vibrations are damped by the first staged damping action and the remnant of string vibration is almost fully damped by the second staged damping action;

said dual-staged applying means including a leaf spring disposed at a central section of said damper head; and said at least one damper felt being disposed on the bottom of said leaf spring.

5. The improved damper assembly as claimed in claim 4 in which said leaf spring is disposed on the bottom face of said damper head.

6. The improved damper assembly as claimed in claim 5 in which the length of said leaf spring is substantially the same as the longitudinal length of said damper head, and the end sections of said leaf spring are slightly bent downwards.

7. The improved damper assembly as claimed in claim 5 in which the end sections of said leaf spring extend beyond the longitudinal ends of said damper head, and are slightly bent downwards.

8. The improved damper assembly as claimed in claim 4 in which said leaf spring is disposed on the top face of said damper head, and the end sections of said leaf spring extend beyond the longitudinal ends of said damper head, and are slightly bent downwards.

9. An improved damper assembly for a piano comprising:

a damper head arranged relative to an associated string of the piano;

at least one damper felt disposed between said damper head and said associated string;

dual-staged applying means for applying first and second staged damping actions to said associated string, said dual-staged applying means being operatively associated with said damper head so that only large amplitude components of string vibrations are damped by the first staged damping action and the remnant of string vibration is almost fully damped by the second staged damping action;

said at least one damper felt being of a triple layered construction having a first layer of felt material facing said string, a second intermediate layer of felt material, and a third layer of felt material facing said damper head, said second layer of felt material being intermediate said first and third layers and being softer than said first layer of felt material, and said third layer of a felt material being softer than said first and second layers of felt material.

10. The improved damper assembly as claimed in claim 9 wherein said first layer includes a longitudinal groove in the face thereof facing said associated string.

11. The improved damper assembly as claimed in claim 9 wherein said damper head is arranged relative to three associated strings, one of said strings being an intermediate string and the other of said strings being outer strings on opposite sides of said intermediate string, and wherein said first layer of said at least one damper felt has chamfered side surfaces and a longitudinally extending groove in the lower face thereof facing said intermediate string, said damper head being arranged so that said intermediate string is adapted to be received in said groove and said outer strings are adapted to engage said chamfered side surfaces of said first layer of said at least one damper felt.

12. An improved damper assembly for a piano comprising:

a damper head arranged relative to an associated string of the piano;

at least one damper felt disposed between said damper head and said associated string;

dual-staged applying means for applying first and second staged damping actions to said associated string, said dual-staged applying means being operatively associated with said damper head so that only large amplitude components of string vibration are damped by the first staged damping action and the remnant of string vibration is almost fully damped by the second staged damping action;

said at least one damper felt being disposed on the bottom face of said damper head at a central section thereof, and being made of a felt material of a predetermined hardness;

said dual action applying means including two additional damper felts disposed on the bottom face of said damper head at longitudinal end sections of said damper head on opposite sides of said at least one damper felt, said two additional felts being made of a felt material which is softer than the felt material of said at least one damper felt; and said two additional damper felts extending downwardly a prescribed distance beyond the bottom face of said at least one damper felt.

13. An improved damper assembly for a piano comprising:

a damper head arranged relative to an associated string of the piano;

at least one damper felt disposed between said damper head and said associated string;

dual-staged applying means for applying first and second staged damping actions to said associated string, said dual-staged applying means being operatively associated with said damper head so that only large amplitude components of string vibration are damped by the first staged damping action and the remnant of string vibration is almost fully damped by the second staged damping action;

said at least one damper felt being disposed on the bottom face of said damper head and being made of a felt material of a predetermined hardness;

said dual-staged applying means including a leaf spring affixed to the bottom face of said damper head and extending beyond the longitudinal ends of said damper head, and additional damper felts disposed on the bottom face of said leaf spring at positions outside the longitudinal ends of said damper head, said additional damper felts being made of a felt material which is softer than the felt material of said at least one damper felt; and said additional damper felts extending downwardly a prescribed distance beyond the bottom face of said at least one damper felt.

14. An improved damper assembly for a piano comprising:

a damper head arranged relative to an associated string of the piano;

at least one damper felt disposed between said damper head and said associated string;

dual-staged applying means for applying first and second staged damping actions to said associated string, said dual-staged applying means being operatively associated with said damper head so that only large amplitude components of string vibrations are damped by the first staged damping action and the remnant of string vibration is almost fully damped by the second staged damping action;

said damper head being made of molded synthetic resin; and said dual-staged applying means including longitudinal end sections of said damper head, and said end sections extending downwardly relative to the central section of said damper head.

* * * * *